US008413579B2

(12) United States Patent
Ferretti

(10) Patent No.: US 8,413,579 B2
(45) Date of Patent: Apr. 9, 2013

(54) STENCIL KIT

(75) Inventor: Gabriella Ferretti, Livorno (IT)

(73) Assignee: Liquiplast S.r.l., Livorno (IT)

( * ) Notice: Subject to any disclaimer, the term of this patent is extended or adjusted under 35 U.S.C. 154(b) by 190 days.

(21) Appl. No.: 12/873,095

(22) Filed: Aug. 31, 2010

(65) Prior Publication Data

US 2011/0056394 A1 Mar. 10, 2011

(30) Foreign Application Priority Data

Sep. 1, 2009 (IT) ..... TO2009U0120

(51) Int. Cl.
*B41N 1/24* (2006.01)

(52) U.S. Cl.
USPC ..... 101/127; 101/114

(58) Field of Classification Search ..... 101/127, 101/114; *B41N 1/24*
See application file for complete search history.

(56) References Cited

U.S. PATENT DOCUMENTS 373,838 A * 11/1887 Lowenson ..... 101/127
1,351,068 A * 8/1920 Sayford ..... 101/129
5,460,087 A 10/1995 Ogorzalek
7,156,017 B1 1/2007 Ingraselino
2007/0095220 A1 5/2007 Cox et al.
2008/0282914 A1 11/2008 Black et al.

FOREIGN PATENT DOCUMENTS

GB 2225285 A * 5/1990

OTHER PUBLICATIONS

European Search Report for corresponding European Patent Application No. 10174860 dated Feb. 9, 2011.

* cited by examiner

*Primary Examiner* — Leslie J Evanisko
(74) *Attorney, Agent, or Firm* — Sughrue Mion, PLLC

(57) ABSTRACT

The stencil kit comprises: a first stencil (1*a*) including a first support (2*a*) on which a first outer template (4*a*) is provided, the first outer template (4*a*) being formed by a plurality of cut out sections (6*a*) defining a cut out broken line which extends throughout the outer contour of the final decoration; and a second stencil (1*b*) including a second support (2*b*) on which a second outer template (4*b*) is provided, the second outer template (4*b*) being formed by a plurality of cut out sections (6*b*) defining a cut out broken line which extends throughout the outer contour of the final decoration. The broken line of the second stencil (1*b*) is complementary to that of the first stencil (1*a*).

5 Claims, 1 Drawing Sheet

STENCIL KIT

BACKGROUND OF THE INVENTION

The present invention relates to a stencil kit, particularly for decoration of walls, pieces of furniture or doors.

As is well known, a stencil allows to reproduce in series identical shapes, symbols or letters in a more or less stylized form on a substrate, such as the surface of a wall. The stencil is formed by a support or backing sheet, for instance a sheet of cardboard or plastics, in which some portions of material are cut out to obtain a physical negative of the image or decoration to be reproduced. Application of paint or varnish on the stencil will then result in the cut out image or decoration to be impressed onto the surface behind the stencil (substrate), since colour will pass only through the cut out sections.

In order to obtain elaborate decorations, a number of stencils are often used, each of which reproduces a respective portion of the decoration. The more elaborate the decoration, the more numerous are the stencils to be used, since each of them reproduces a specific detail of the final decoration. The stencils are applied in sequence and must therefore be perfectly aligned with each other in use, whereby all the portions of the decoration which are reproduced one by one on the substrate match with each other with no overlapping, misalignments or gaps. These alignment operations require great skill from the user and are also rather laborious, whereby a lot of time must be spent to finish the decoration.

SUMMARY OF THE INVENTION

It is therefore an object of the present invention to provide an innovative stencil kit which allows to obtain easily and quickly an elaborate decoration with the use of a reduced number of stencils.

This and other objects are fully achieved according to the present invention by virtue of a stencil kit having the features set forth in independent claim 1.

Advantageous embodiments are defined in the dependent claims, the content of which is to be intended as integral and integrating part of the present description.

In short, the stencil kit according to the invention comprises first and second separate stencils, each of which is formed by a support or backing sheet on which the whole decoration is reproduced. In each of the first and second stencils, sections of the support sheet are cut out throughout the contour of decoration, in such a manner that the cut out sections of the first stencil are complementary to the cut out sections of the second stencil. By arranging the two stencils one after the other on the substrate and applying paint or varnish onto them, all the lines forming the final decoration will thus be obtained.

BRIEF DESCRIPTION OF THE DRAWINGS

Further features and advantages of the present invention will result from the following detailed description, given purely by way of non-limiting example with reference to the appended drawings, in which.

DETAILED DESCRIPTION OF THE PREFERRED EMBODIMENTS

Figure 1:
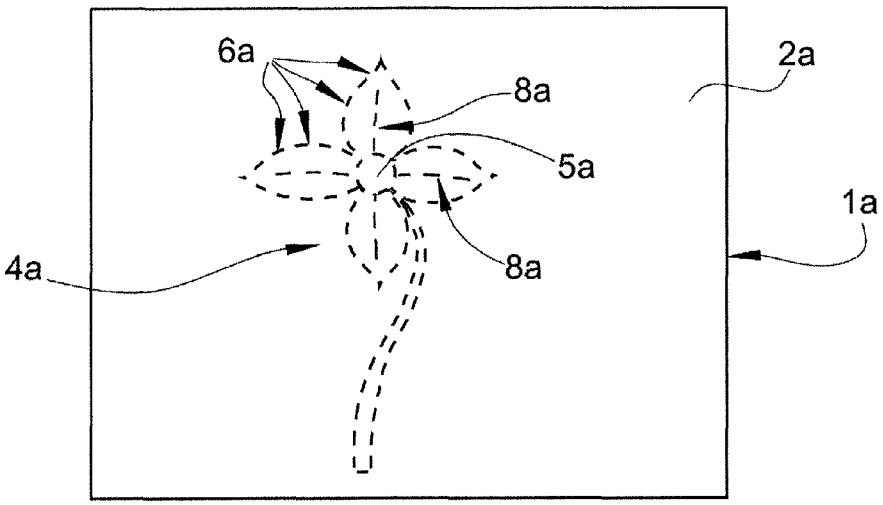
FIG. 1 is a view from above of a first stencil of the stencil kit according to the invention.
Figure 2:
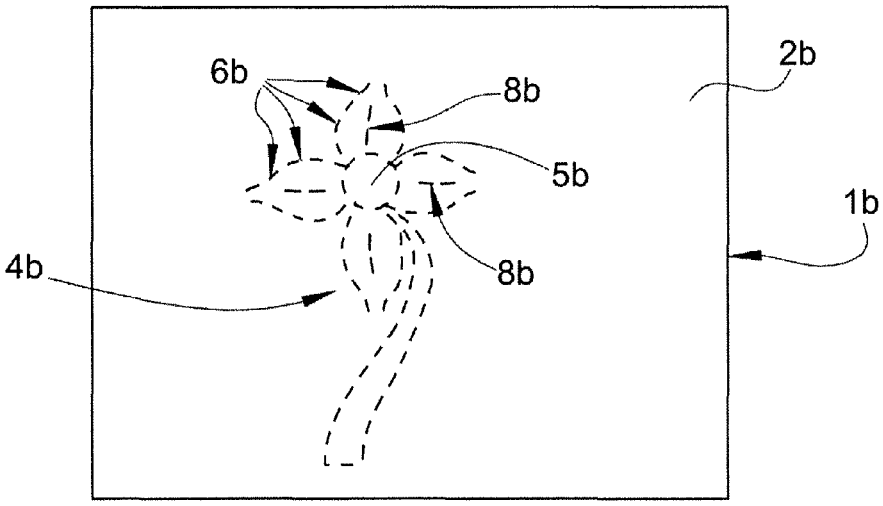
FIG. 2 is a view from above of a second stencil of the stencil kit according to the invention.

A stencil kit according to the invention comprises first and second separate stencils, as illustrated in FIGS. 1 and 2, which are intended to reproduce on a substrate, such as for instance the surface of a wall, a final decoration defined by a solid-line outer contour. Advantageously, the final decoration comprises at least an inner decoration element having an inner contour which is fully contained within the outer contour of the final decoration. Preferably, separation lines are provided within the final decoration and/or within the inner decoration element and allow to separate light and dark areas or other details of the final decoration.

In FIG. 1 the first stencil of the stencil kit according to the invention is generally indicated 1*a*. The first stencil comprises a first support sheet 2*a* (or backing sheet), for instance a sheet of plastics. A first outer template 4*a* is cut out of the first support sheet 2*a*. Advantageously, at least one first portion of inner template 5*a* is also cut out of the first support sheet 2*a*, the contour of which is fully contained within the contour of the first outer template 4*a*.

The first outer template 4*a* is formed by a plurality of cut out sections 6*a* defining a cut out broken line which extends throughout the outer contour of the final decoration. Advantageously, the first portion of inner template 5*a* is also formed by a plurality of cut out sections 6*a* defining a cut out broken line.

Preferably, first separation lines 8*a* representing details of the final decoration are provided within the first outer template 4*a* and/or within the first portion of inner template 5*a* and are also formed by a plurality of cut out sections 6*a* defining cut out broken lines.

Preferably, the sections 6*a* are equally spaced. Advantageously, the sections 6*a* have the same length. Advantageously, the distance between adjacent sections 6*a* is equal to the length of each section 6*a*.

FIG. 2 shows the second stencil (indicted 1*b*) of the stencil kit, which comprises a second support sheet 2*b* (or backing sheet), for instance a sheet of plastics. A second outer template 4*b* identical to the first outer template 4*a* of the first stencil 1*a* is cut out of the second support sheet 2*b*. Advantageously, at least one second portion of inner template 5*b* is also cut out of the second support sheet 2*a* and its contour is fully contained within the contour of the second outer template 4*b*.

The second outer template 4*b* is formed by a plurality of cut out sections 6*b* defining a cut out broken line which extends throughout the outer contour of the final decoration. Advantageously, the second portion of inner template 5*b* is also formed by a plurality of cut out sections 6*b* defining a cut out broken line.

The cut out broken line of the second stencil 1*b* is complementary to that of the first stencil 1*a*, that is to say, solid sections of the broken line of the second stencil 1*b* coincide with cut out sections of the broken line of the first stencil 1*a*, and vice versa.

In this manner, with the first stencil 1*a* a partial reproduction of the final decoration is obtained, more specifically a broken line is obtained which reproduces the cut out broken line of the first outer template 4*a*. Using the second stencil 1*b*, the empty sections (corresponding to the cut out sections) of the broken line of the first outer template 4*a* are filled and the final decoration is thus obtained. The second broken line obtained with the second stencil 1*b* will in fact fill the empty spaces between adjacent solid sections of the first broken line obtained with the first stencil 1*a*, and the solid line of the final decoration will thus be obtained.

Advantageously, second separation lines 8*b* representative of details are provided within the second outer template 4*b* and/or within the second portion of inner template 5*b* and are also formed by a plurality of cut out sections 6*b* defining cut out broken lines. The second separation lines 8*b* are complementary to the first separation lines 8*a*.

Preferably, the sections 6*b* are equally spaced. Advantageously, the sections 6*b* have the same length. Advantageously, the distance between adjacent sections 6*b* is equal to the length of each section 6*b*.

Naturally, the principle of the invention remaining unchanged, the embodiments and manufacturing details may be widely varied with respect to those described and illustrated purely by way of non-limiting example, without thereby departing from the scope of the invention as defined in the appended claims.

What is claimed is:

1. A stencil kit for a final decoration defined by a solid-line outer contour, the stencil kit comprising:

a first stencil (1*a*) including a first support (2*a*) on which a first outer template (4*a*) is provided, the first outer template (4*a*) being formed by a plurality of first cut out sections (6*a*) defining a first cut out broken line which extends throughout the outer contour of the final decoration;

a second stencil (1*b*) including a second support (2*b*) on which a second outer template (4*b*) is provided, the second outer template (4*b*) being formed by a plurality of second cut out sections (6*b*) defining a second cut out broken line which extends throughout the outer contour of the final decoration, wherein the second broken line of the second stencil (1*b*) is complementary to the first broken line of the first stencil (1*a*), wherein the first support (2*a*) further comprises a first inner template (5*a*) provided thereon, wherein at least one first portion of the first inner template is formed by a plurality of inner cut out sections (6*a*) defining an inner cut out broken line, the contour of said at least one first portion of the first inner template (5*a*) being fully contained within the contour of the first outer template (4*a*), wherein the second support (2*b*) further comprises a second inner template (5*b*) provided thereon, wherein at least one second portion of the second inner template (5*b*) is formed by a plurality of inner cut out sections (6*b*) defining an inner cut out broken line, the contour of said at least one second portion of the second inner template (5*b*) being fully contained within the contour of the second outer template (4*b*), and wherein the inner broken line of the at least one second portion of the second inner template (5*b*) is complementary to the inner broken line of the at least one first portion of the first inner template (5*a*).

2. Stencil kit according to claim 1, wherein at least one first separation line (8*a*) is provided on the first support (2*a*) within the first outer template (4*a*) and is formed by a plurality of cut out sections (6*a*) defining a cut out broken line, wherein at least one second separation line (8*b*) is provided on the second support (2*b*) within the second outer template (4*b*) and is formed by a plurality of cut out sections (6*b*) defining a cut out broken line, and wherein said at least one second separation line (8*b*) is complementary to said at least one first separation line (8*a*).

3. Stencil kit according to claim 1, wherein the first cut out sections (6*a*) of the first stencil (1*a*) and the second cut out sections (6*b*) of the second stencil (1*b*) are equally spaced.

4. Stencil kit according to claim 1, wherein the first cut out sections (6*a*) of the first stencil (1*a*) and the second cut out sections (6*b*) of the second stencil (1*b*) have the same length.

5. Stencil kit according to claim 1, wherein the distance between adjacent first or second cut out sections (6*a*, 6*b*) is equal to the length of each first or second cut out section (6*a*, 6*b*), respectively.

* * * * *